US007335004B2

(12) United States Patent
Lee et al.

(10) Patent No.: US 7,335,004 B2
(45) Date of Patent: Feb. 26, 2008

(54) APPARATUS FOR VARYING CAPACITY IN SCROLL COMPRESSOR

(75) Inventors: Byeong-Chul Lee, Seoul (KR); Myung-Kyun Kim, Incheon (KR)

(73) Assignee: LG Electronics Inc., Seoul (KR)

( * ) Notice: Subject to any disclaimer, the term of this patent is extended or adjusted under 35 U.S.C. 154(b) by 41 days.

(21) Appl. No.: 11/085,188

(22) Filed: Mar. 22, 2005

(65) Prior Publication Data

US 2006/0140804 A1 Jun. 29, 2006

(30) Foreign Application Priority Data

Dec. 23, 2004 (KR) ..... 10-2004-0111453

(51) Int. Cl.
*F03C 2/00* (2006.01)
*F04C 18/00* (2006.01)

(52) U.S. Cl. ..... 418/55.2; 418/55.1; 417/310

(58) Field of Classification Search ..... 418/55.1, 418/55.2, 217; 417/213, 310
See application file for complete search history.

(56) References Cited

U.S. PATENT DOCUMENTS 4,457,674 A * 7/1984 Kawano et al. ..... 418/55.2
4,477,238 A * 10/1984 Terauchi ..... 418/5
5,496,161 A * 3/1996 Machida et al. ..... 418/55.2
5,577,897 A * 11/1996 Inagaki et al. ..... 417/310
5,678,985 A * 10/1997 Brooke et al. ..... 417/299
6,231,316 B1 * 5/2001 Wakisaka et al. ..... 417/310
6,379,123 B1 * 4/2002 Makino et al. ..... 417/310
6,419,470 B2 * 7/2002 Fujii et al. ..... 418/55.2
6,457,948 B1 * 10/2002 Pham ..... 417/310
6,478,550 B2 * 11/2002 Matsuba et al. ..... 417/310
6,527,527 B2 * 3/2003 Fujita et al. ..... 418/55.2
6,746,224 B2 * 6/2004 Itoh et al. ..... 418/55.2
2004/0042911 A1 * 3/2004 Hong et al. ..... 417/284
2005/0053507 A1 * 3/2005 Takeuchi et al. ..... 418/55.1
2005/0100469 A1 * 5/2005 Matsunaga et al. ..... 418/55.1

FOREIGN PATENT DOCUMENTS

CN 1094566 C 11/2002
JP 57-140588 A 8/1982
JP 05288169 A * 11/1993
JP 2000-257573 A 9/2000

* cited by examiner

*Primary Examiner*—Thomas Denion
*Assistant Examiner*—Mary A Davis
(74) *Attorney, Agent, or Firm*—Birch, Stewart, Kolasch & Birch, LLP

(57) ABSTRACT

An apparatus for varying the capacity in a scroll compressor, the apparatus having an orbiting scroll provided with a wrap filling portion which is stepped at a certain height, extending the entire inside of a wrap from an outer end portion of the wrap; a fixed scroll provided with a stepped wrap obtained by stepping a wrap corresponding to the wrap filling portion of the orbiting scroll and being in meshing arrangement with the orbiting scroll; a connection passage for connecting compression pockets formed by the outer wrap portion of the orbiting scroll and the inside of the wrap of the fixed scroll opposed to the outside of the outer wrap portion with the suction opening; and an opening/closing unit for opening or closing the connection passage such that the suction opening side and the compression pockets can be connected and disconnected to each other.

8 Claims, 7 Drawing Sheets

APPARATUS FOR VARYING CAPACITY IN SCROLL COMPRESSOR

BACKGROUND OF THE INVENTION

1. Field of the Invention

The present invention relates to a scroll compressor, and more particularly, to an apparatus for varying the capacity in a scroll compressor capable of minimizing power consumption by widening a range of varying the capacity of the compressor.

2. Description of the Background Art

In general, a compressor converts electric energy into kinetic energy, and compresses a refrigerant by the kinetic energy. The compressor is the kernel of a freezing cycle system, and according to compression mechanisms, there are various kinds of compressors such as a rotary compressor, a scroll compressor, a reciprocating compressor and the like. The freezing cycle system including such a compressor is used in a refrigerator, a showcase or the like.

In general, a scroll compressor continuously sucks, compresses and discharges a gas as an orbiting scroll orbits in meshing engagement with a fixed scroll upon receiving a driving force of a driving motor. The orbiting scroll and the fixed scroll are provided with wraps having an involute shape, respectively. A plurality of compression pockets are formed by the wrap of the fixed scroll and the wrap of the orbiting scroll. According to the orbiting movement of the orbiting scroll, while the compression pockets move towards a discharge hole through which the gas is discharged and are gradually contracted in volume, thereby compressing a gas.

In general, one pair of compression pockets, each of which is symmetrical about a discharge port, are formed. Two compression pockets as one pair have an identical volume. When one pair of compression pockets move towards a discharge hole as gas is sucked at the suction side, another pair of compression pockets following one pair of compression pockets are formed at the suction side. Such processes are repeatedly performed.

Meanwhile, an asymmetrical scroll compressor in which a volume of one compressor out of one pair of compression pockets is relatively large has been developed as a structure by which a volume to be compressed by the compression pockets can be increased.

In the scroll compressor, a rotary force generated from the driving motor is transmitted to the orbiting scroll as follows. An eccentric portion of a rotary shaft coupled to the driving motor is inserted into a boss portion formed at a lower portion of a circular plate of the orbiting scroll, and the rotary force is transmitted to the boss portion of the orbiting scroll through the eccentric portion of the rotary shaft. However, in case there are big changes in volumes in the compression pockets formed by the wrap of the fixed scroll and the wrap of the orbiting scroll, such a structure makes the orbiting movement of the orbiting scroll unstable because the compression pockets for compressing a gas is at a certain distance from the boss portion and the eccentric portion to which the rotary force of the driving force is transmitted.

In addition, as shown in FIGS. 1 and 2, as a structure for increasing the compression volume of the scroll compressor, a wrap 12 having a certain height is formed on a circular plate 11 of an orbiting scroll 10, and a wrap filling portion 13 having a certain height is formed at the wrap 12 side at the center of the circular plate 11. The wrap filling portion 13 is formed with a certain height to be positioned inside the wrap 12 from an inner end of the wrap 12 to a portion at which the wrap 12 is extended by a 360 angle. In addition, an insertion groove 14 into which an eccentric portion 21 of a rotary shaft 20 is inserted is formed at a lower surface of the circular plate 11, and the insertion groove 14 is formed to the inner side of the wrap filling portion 13. And, the eccentric portion 21 of the rotary shaft is inserted into the insertion groove 14. A section of the wrap filling portion 13 has such a shape that the eccentric portion 21 of the rotary shaft can be inserted into.

In such a structure, the eccentric portion 21 of the rotary shaft is positioned to the inner side of the wrap filling portion 13 of the orbiting scroll. Accordingly, as a position at which compression pockets (P) formed by the wrap 12 of a fixed scroll 30 in meshing engagement with the orbiting scroll 10 and the wrap 12 of the orbiting scroll overlaps with a position of the eccentric portion 21 to which a rotary force is transmitted, the structure allows the stable orbiting movement of the orbiting scroll 10 on condition that compression ratio is high. Moreover, since the wrap filling portion 13 is formed at the center of the orbiting scroll wrap 12, a volume of the discharge side is reduced, thereby relatively increasing the compression ratio of the gas to be discharged. Such a technique is proposed in JP2000-329079.

Meanwhile, in case of an airconditioner using a freezing cycle system provided with a compressor, varying the capacity of the compressor is required to reduce power consumption of the airconditioner according to a change of seasons: spring, summer, autumn and winter.

The mechanisms for varying the capacity of the compressor includes a method for controlling the number of the rotation of the driving motor constituting the compressor, a method for bypassing or leaking a gas, and a method of mixing the two.

The method for controlling the number of the rotation of the driving motor has a wide range of varying the capacity and the excellent performance, but manufacturing unit cost is high. Also, an additional device is required to settle the oil supply problem by the small rotation number, and reliability on a rubbing portion needs to be secured by the great rotation number.

The method for bypassing a gas can reduce manufacturing unit cost, but has a narrow range of varying the capacity and the low performance.

SUMMARY OF THE INVENTION

Therefore, an object of the present invention is to provide an apparatus for varying the capacity capable of not only reducing manufacturing unit cost but also widening a range of varying the capacity.

To achieve these and other advantages and in accordance with the purpose of the present invention, as embodied and broadly described herein, there is provided apparatus for varying the capacity in a scroll compressor, comprising: an orbiting scroll provided with a wrap filling portion which is stepped at a certain height, extending the entire inside of a wrap from an outer end portion of the wrap; a fixed scroll provided with a stepped wrap obtained by stepping a wrap corresponding to the wrap filling portion of the orbiting scroll and being in meshing arrangement with the orbiting scroll; a connection passage for connecting compression pockets formed by the outer wrap portion of the orbiting scroll and the inside of the wrap of the fixed scroll opposed to the outside of the outer wrap portion with the suction opening; and an opening/closing unit for opening or closing the connection passage such that the suction opening side and the compression pockets can be connected and disconnected to each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of an apparatus for varying the capacity in a scroll compressor in accordance with the present invention, examples of which are illustrated in the accompanying drawings.

Figure 1:
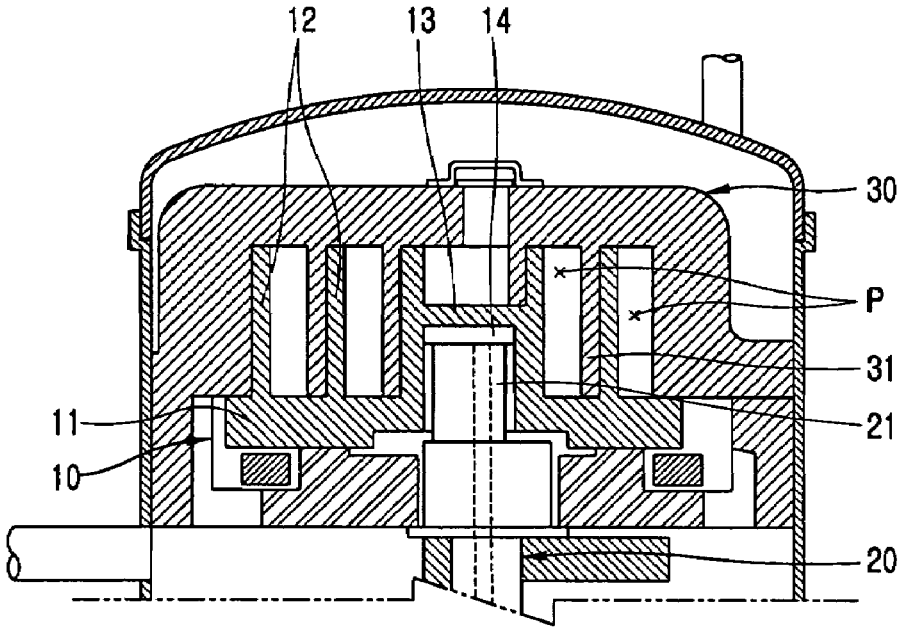
FIG. 1 CONVENTIONAL ART
FIG. 1 is a cross-sectional view showing a conventional compression part of the conventional scroll compressor.
Figure 2:
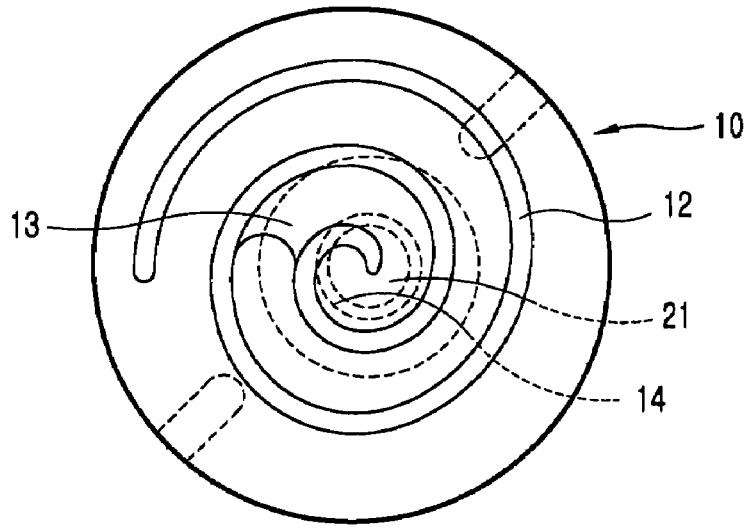
FIG. 2 CONVENTIONAL ART
FIG. 2 is a plan view showing an orbiting scroll of the scroll compressor.
Figure 3:
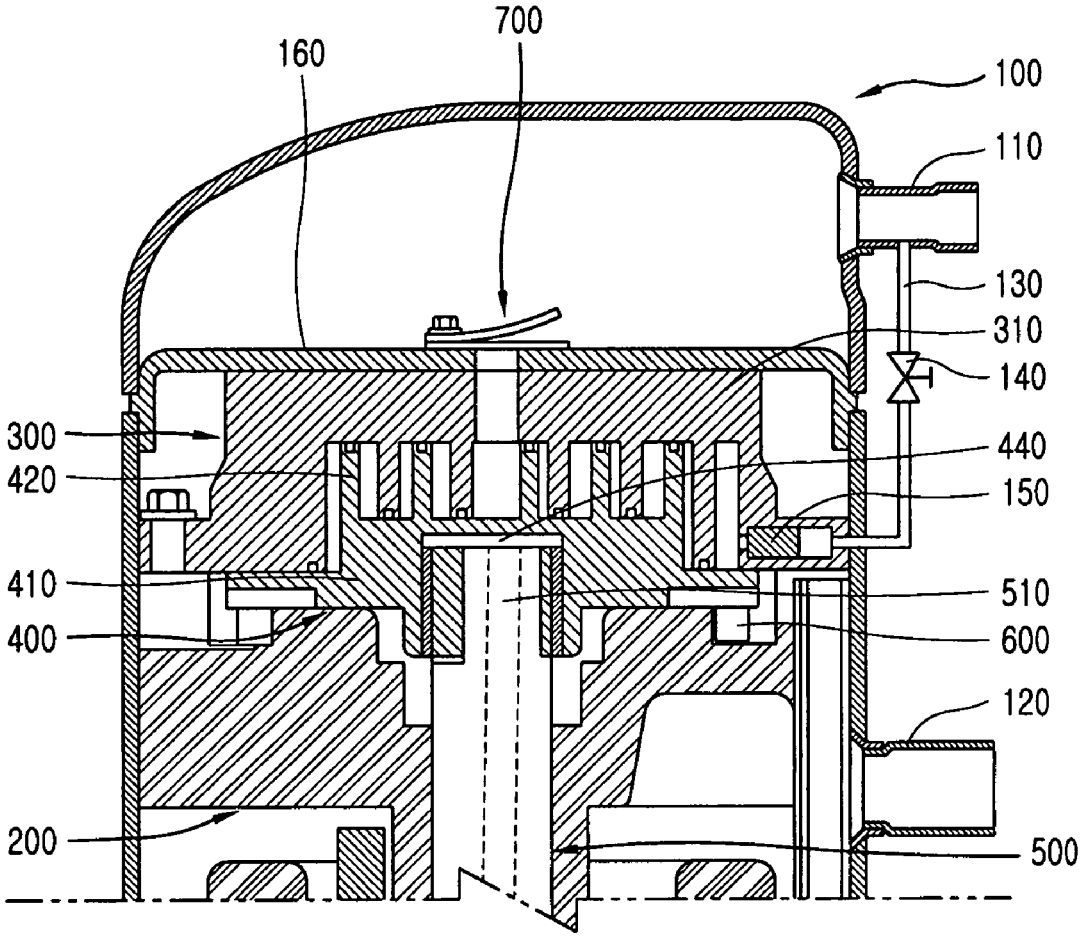
FIGS. 3 and 4 are a front sectional view and a plan sectional view showing a compression part of a scroll compressor provided with an apparatus for varying the capacity in a scroll compressor in accordance with the present invention.
Figure 4:
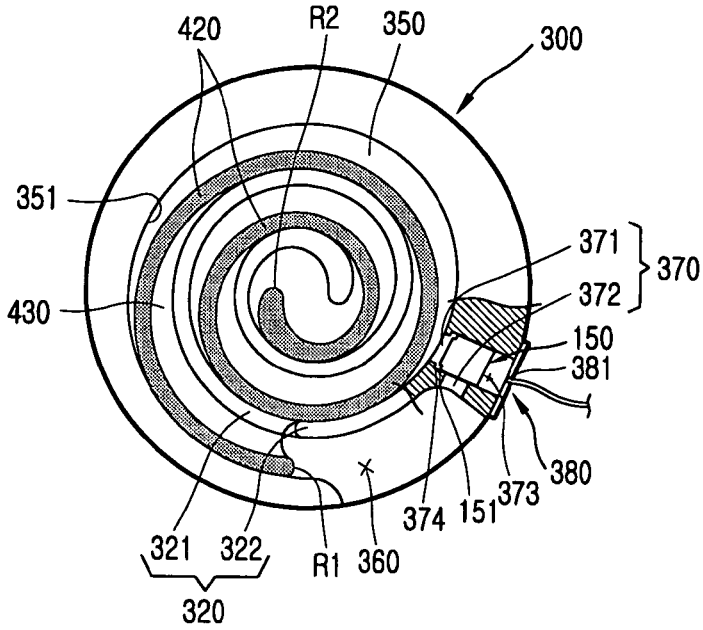

FIGS. 3 and 4 are a front sectional view and a plan sectional view of a compression part of a scroll compressor provided with an apparatus for varying the capacity in a scroll compressor in accordance with the present invention.

As shown therein, the compression part of the scroll compressor is described as follows.

A main frame 200 is mounted in a hermetic container 100, a fixed scroll 300 is mounted in the hermetic container 100 at a certain interval, and an orbiting scroll 400 is positioned between the fixed scroll 300 and the main frame 200 such that the orbiting scroll can orbit in meshing arrangement with the fixing scroll 300. A rotary shaft 500 coupled to a driving motor is penetratingly inserted into the main frame 200 and is coupled to the orbiting scroll 400.

Figure 5:
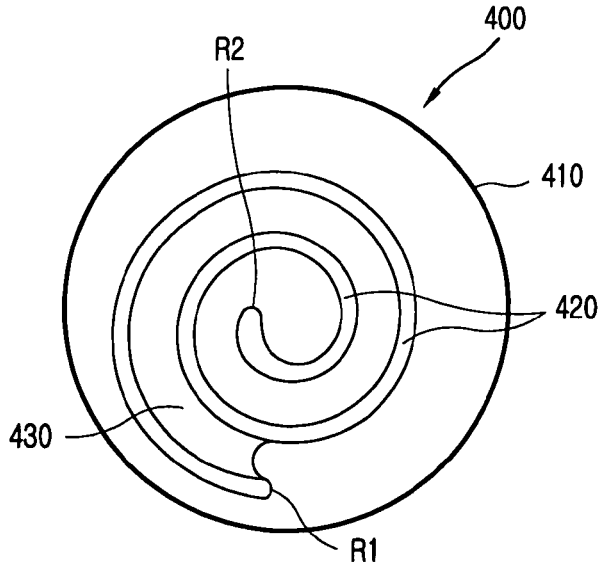
FIGS. 5 and 6 are a front view and a perspective view showing an orbiting scroll constituting the compression part of the scroll compressor.
Figure 6:
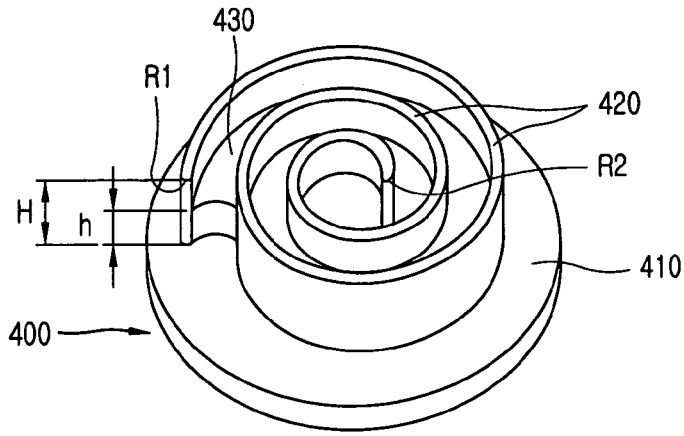

As shown in FIGS. 5 and 6, the orbiting scroll 400 includes a wrap 420 formed as an involute shape having predetermined thickness and height formed at one surface of a circular plate 410 having certain thickness and height, a wrap filling portion 430 having a certain height, ranging from an end portion (R1) of the most outer side of the wrap 420 to an inner end portion (R2) of the wrap 420, and an insertion groove 440 having a certain depth formed at the other lower surface of the circular plate 410.

The wrap filling portion 430 preferably protrudes from one surface of the circular plate 410 at a certain height, and the height (h) of the wrap filling portion 430 is lower than the height (H) of the wrap. The wrap filling portion 430 preferably starts from the outer end portion (R1) of the most outer side of the wrap 420 and an outer surface of the wrap 420 portion of the side of the end portion (R1), and its start portion is preferably formed as a curved surface. Meanwhile, the wrap filling portion 430 can be formed as a separate part and coupled to the inside of the wrap 420. The insertion groove 440 is formed to the inside of the wrap filling portion 430. Also, the insertion groove 440 is formed such that an eccentric portion 510 formed at one side of a rotary shaft 500 can be inserted into.

Figure 7:
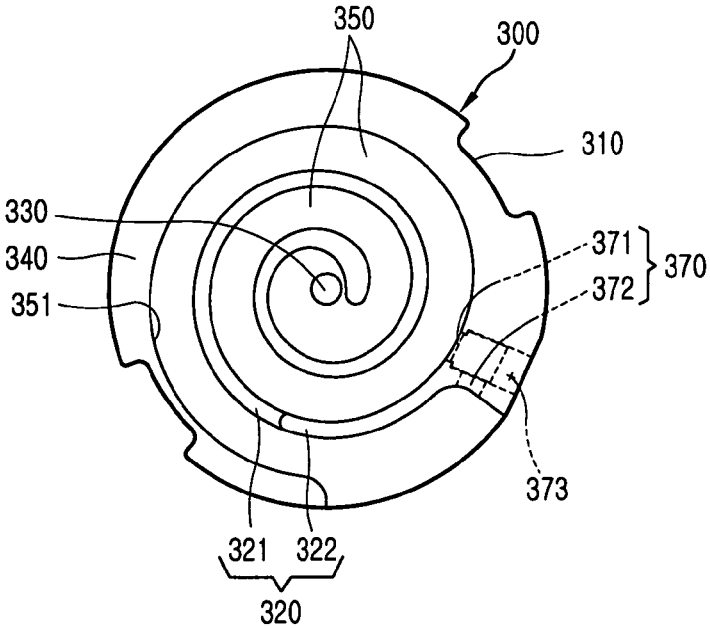
FIGS. 7 and 8 are a front view and a perspective view showing a fixed scroll constituting the compression part of the scroll compressor.
Figure 8:
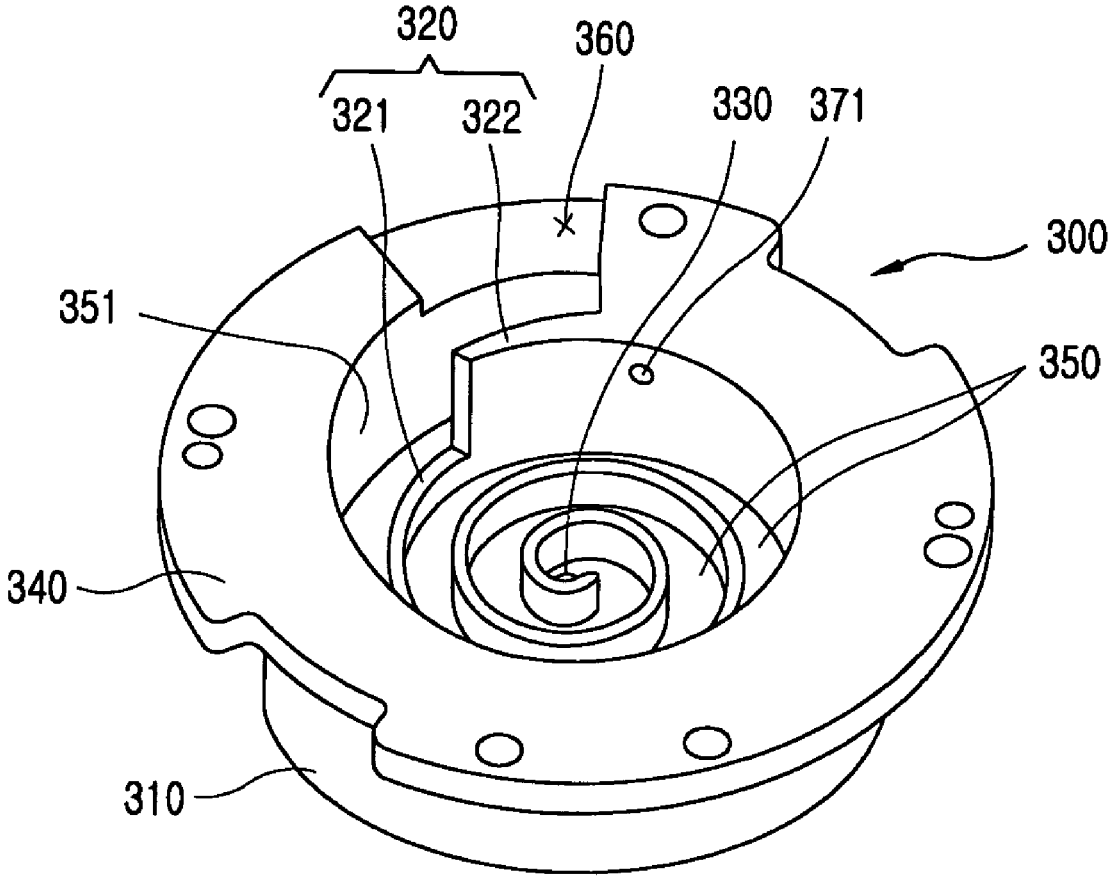

As shown in FIGS. 7 and 8, the fixed scroll 300 includes a wrap 320 having an involute curve shape having certain thickness and height formed at one surface of a body 310 formed as a predetermined shape, and a discharge hole 330 formed at the center of the body 310. As a spiral groove 350 having a certain depth is formed at a contact surface 340 in contact with an upper surface of the circular plate portion 410 of the orbiting scroll 400 in the body 310, the wrap 320 is protrudingly formed. The protruding wrap 320 starts from a portion where the spiral groove 350 starts (an end portion of the most outer side of the spiral groove), and an inner wall 351 alone is formed before the protruding wrap 320 starts.

In addition, the wrap 320 of the fixed scroll is made up of a stepped wrap 321 in which a portion opposed to the wrap filling portion 430 of the orbiting scroll is stepped, and a wrap 322 having a general height. The step height of the stepped wrap 321 is formed to be identical to a height obtained by subtracting the height (h) of the wrap filling portion 430 from the wrap height (H) of the orbiting scroll. Also, a suction opening 360 for sucking a gas is formed at one side of the body 310. The suction opening 360 is formed at a portion where the wrap 320 starts, and the suction opening 360 is opened at a side surface of the body 310.

The orbiting scroll 400 is inserted between the main frame 200 and the fixed scroll 300 such that the wrap 420 can be in meshing arrangement with the wrap 320 of the fixed scroll. At this time, an end surface of the stepped wrap 321 of the fixed scroll is in contact with a surface of the wrap filling portion 430 of the orbiting scroll, and the contact surface 340 of the fixed scroll is in contact with an upper surface of the circular plate 410 of the orbiting scroll 400.

When the orbiting scroll 400 orbits, a plurality of compression pockets are formed by the wrap 420 of the orbiting scroll and the wrap 320 of the fixed scroll.

A connection passage 370 for connecting the compression pockets formed by the outer wrap 420 and an inner wall 351 of the fixed scroll 300 opposed to the outer surface of the outer wrap 420 or an inner wall of the wrap 320 with the suction opening 360 through which a gas flows into the compression pockets is formed.

An opening/closing unit for opening or closing the connection passage 370 is provided such that the suction opening 360 side and the compression pockets are connected or disconnected to each other.

An Oldham ring 600 for preventing a self-rotation of the orbiting scroll 400 is coupled between the orbiting scroll 400 and the main frame 200, and a discharge valve assembly 700 for opening or closing the discharge hole 330 of the fixed scroll 300 is mounted at an upper surface of the fixed scroll 300.

A suction pipe 120 for sucking a gas is coupled to one side of the hermetic container 100, and a discharge pipe 110 for discharging a gas is coupled at the other side of the hermetic container 100.

The opening/closing unit includes: a sliding space 373 having a predetermined inner space so as to communicate with the connection passage 370; a connection pipe 130 for connecting the discharge pipe 110 for discharging a gas with the sliding space 373; an opening/closing valve 140 mounted at the connection pipe 130 and opening or closing the connection pipe 130; and a slider 150 slidably inserted into the sliding space 373 and opening or closing the connection passage 370 while moving by the pressure difference between the discharge side and the compression pockets.

In addition, the connection pipe 130 can be coupled to connect a through hole (not shown) penetratingly formed at the fixed scroll 300 so as to be positioned at the sliding space 373 and a portion where middle pressure applies with the sliding space 373.

The connection passage 370 is preferably formed at the body 310 of the fixed scroll.

The connection passage 370 is composed of a first through hole 371 communicating with the spiral groove 350 and formed at an outer circumferential surface of the body 310, a second through hole 372 communicating with the suction opening 360 and formed at a side portion of the first through hole 371, and a stepped surface 374 formed at an inner wall of the first through hole 371.

The slider 150 is formed to have a certain length with respect to a section corresponding to a section of the first through hole 371 and includes a stepped surface 151 formed at an outer surface thereof. The slider 150 is shorter than the first through hole 371. The slider 150-is inserted into the first through hole 371, and the stepped surface 151 of the slider is caught by the stepped surface 374 of the first through hole. As the stepped surface 151 of the slider is caught by the stepped surface 374 of the first through hole, an end surface of the slider 150 does not protrude towards the inner wall 351 of the spiral groove 350. In a state that the slider 150 is inserted into the first through hole 371, a cover 380 is coupled to an outer circumferential surface of the body 310 in order to close up the first through hole 371. A through hole 381 is formed at one side of the cover 380, and the through hole 381 is connected to the connection pipe 130. When the slider 150 moves toward the cover 380, the suction opening 360 communicates with the inside of the spiral groove 350. When the slider 150 moves toward the spiral groove 350, the suction opening 360 and the spiral groove 350 are closed up.

One side of the first through hole 371 forms the sliding space 373.

One pair of compression pockets formed by the wrap 320 of the fixed scroll and the wrap 420 of the orbiting scroll can be asymmetrical with different volumes and can be symmetrical with an identical volume.

Undescribed reference numeral 160 is a low/high pressure separation plate.

Hereinafter, operational effects of the apparatus for varying the capacity in the scroll compressor in accordance with the present invention will be described as follows.

Firstly, the operation of the compression part of the scroll compressor is the same as described above, the rotary force of the driving part is transmitted to the rotary shaft 500, the rotary force is transmitted to the orbiting scroll 400 through the eccentric portion of the rotary shaft, and the orbiting scroll 400 in meshing arrangement with the fixed scroll 300 orbits about the center of the rotary shaft 500.

In the process, when the scroll compressor operates with one hundred percents of capacity, the connection passage 370 for connecting the suction opening 360 to the inside of the spiral groove 350 is closed by using the opening/closing unit.

Figure 9:
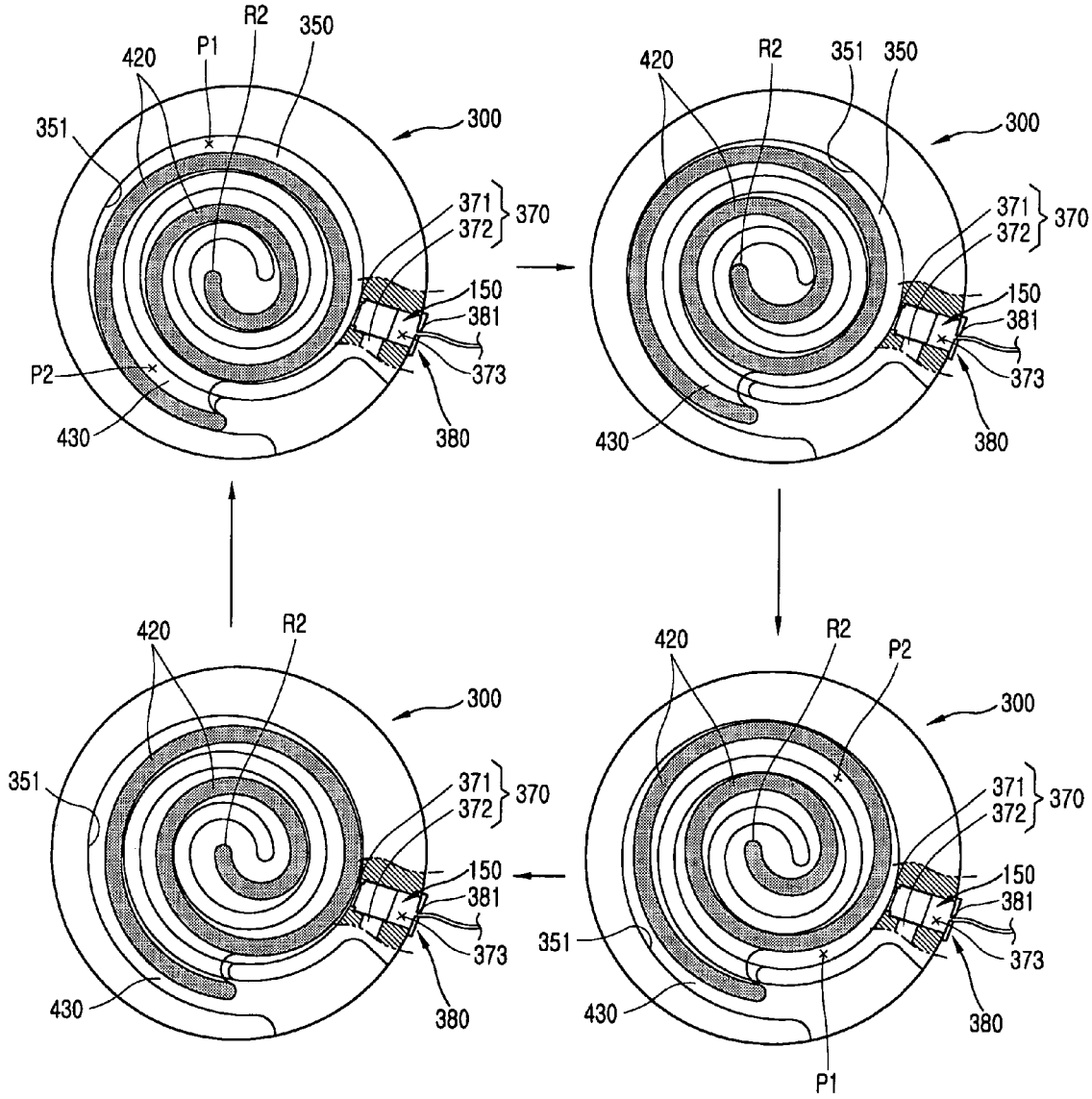
FIGS. 9 and 10 are plane views sequentially showing the operation of the apparatus for varying the capacity in the scroll compressor in accordance with the present invention.

Under such a condition, if the orbiting scroll 400 orbits, as shown in FIG. 9, according to the orbiting movement of the wrap 420 of the orbiting scroll in meshing arrangement with the wrap 320 of the fixed scroll, a first outer compression pocket (P1) is formed by the most outer side of the outer wall of the orbiting scroll wrap 420 and the inner wall 351 of the fixed scroll 300 opposed to the outer wall of the wrap 420, and a gas introduced through the suction opening 360 flows into the first outer compression pocket (P1). At this time, the first outer compression pocket (P1) is not positioned at the wrap filling portion 430 of the orbiting scroll 400.

In addition, if the orbiting scroll 400 orbits a little more, the first outer pocket (P1) moves towards the discharge hole 330 and is contracted in volume, and at the same time, a first inner compression pocket (P2) is formed by the most outer side of the inner wall of the orbiting scroll wrap 420 and the most outer side of the outer wall of the fixed scroll wrap 320. The gas introduced through the suction opening 360 is filled in the first inner compression pocket (P2). At this time, the outer compression pocket (P1) is positioned at a region of the wrap filling portion 430 of the orbiting scroll and has a big change in volume. Also, the first inner compression pocket (P2) is positioned at the wrap filling portion 430 region of the fixed scroll.

In addition, if the orbiting scroll 400 orbits a little more, the first outer compression pocket (P1) and the first inner compression pocket (P2) move towards the center of the fixed scroll 300 and change in their volumes, and a gas compressed in the first outer compression pocket (P1) and the first inner compression pocket (P2) is discharged into a high pressure area of the hermetic container 100 through the discharge hole 330. By repeating such processes, the gas is compressed, the high temperature high pressure gas discharged into the high pressure area of the hermetic container 10 is discharged to the outside through the discharge pipe 120.

When the first outer compression pocket (P1) in which the suction has been finished moves towards the discharge hole 330, the first outer compression pocket (P1) passes through the wrap filling portion 430 and is greatly contracted in volume, thereby having a very high compression ratio.

Meanwhile, when the scroll compressor operates with the variable capacity, the connection passage 370 for connecting the suction opening 360 to the inside of the spiral groove 350 is opened by using the opening/closing unit.

Figure 10:
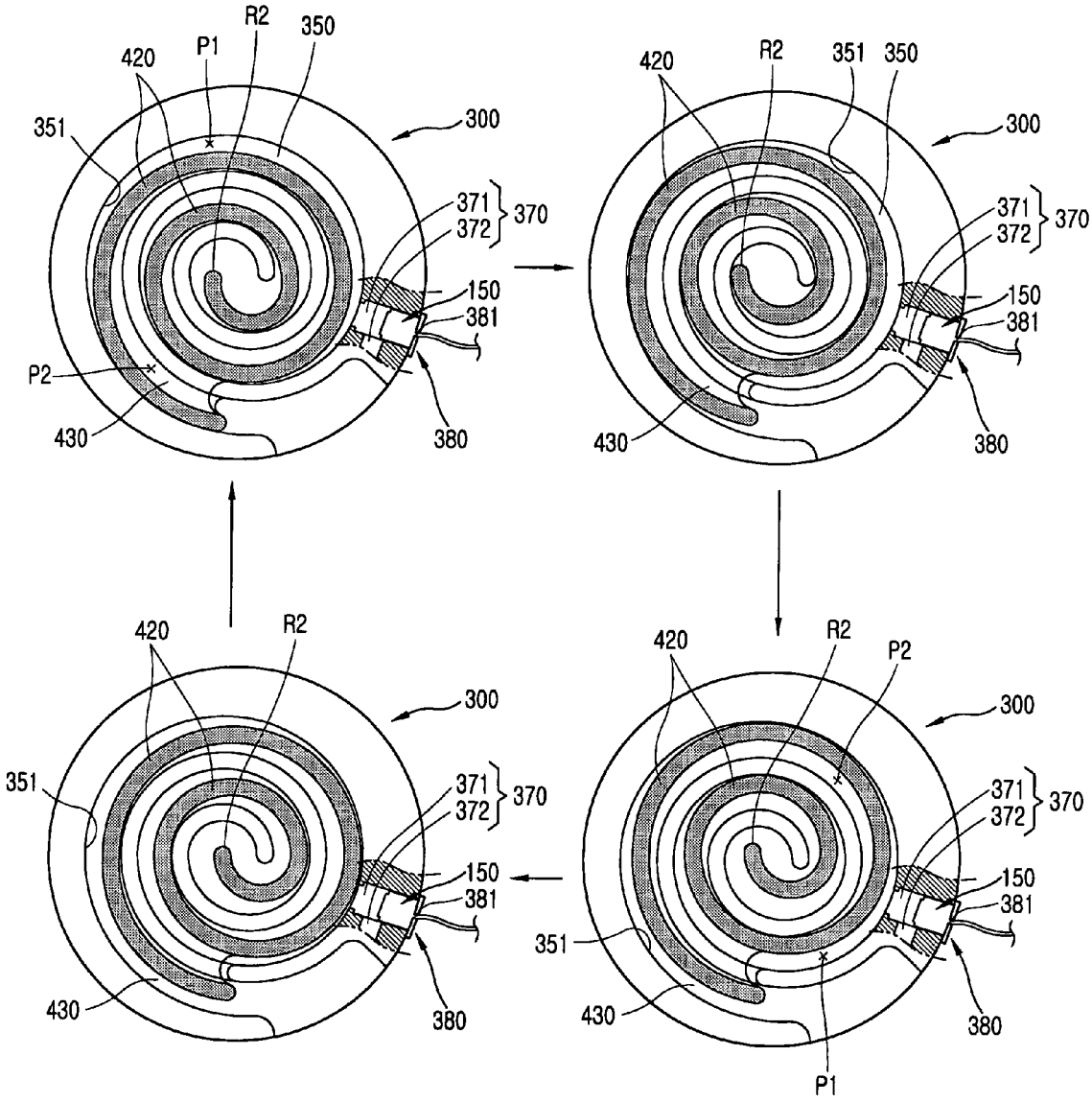

During the operation of the scroll compression under such a condition, when the orbiting scroll 400 orbits, as shown in FIG. 10, the wrap 420 of the orbiting scroll orbits in meshing arrangement with the wrap 320 of the fixed scroll and therefore the first outer compression pocket (P1) is formed by the most outer side of the outer wall of the orbiting scroll wrap 420 and the inner wall 351 of the fixed scroll 300 opposed to the outer wall of the wrap 420. The gas introduced through the suction opening 360 is filled in the first outer compression pocket (P1). But, the connection passage 370 is opened by the opening/closing unit and the first outer compression pocket (P1) and the suction opening 360 are connected to each other, whereby the inside of the first outer compression pocket (P1) has the same pressure state as the suction opening 360. At this time, the first outer compression pocket (P1) is not positioned at the wrap filling portion 430 of the orbiting scroll.

In addition, if the orbiting scroll 400 orbits a little more, the first outer compression pocket (P1) moves towards the discharge hole 330 and is contracted in volume. At the same time, the first inner compression pocket (P2) is formed by the most outer side of the inner wall of the orbiting scroll wrap 420 and the most outer side of the outer wall of the fixed scroll wrap 320, and the gas introduced through the suction opening 360 is filled in the first inner compression pocket (P2). Also, the first inner compression pocket (P2) is positioned at a part of the wrap filling portion 430 of the fixed scroll. At this time, the inside of the first inner compression pocket (P2) still communicates with the suction opening 360 and therefore has the same pressure state as the suction opening.

And, if the orbiting scroll 400 orbits a little more, the first outer compression pocket (P1) moves towards the discharge hole 330 and escapes from the connection passage 370, thereby performing compression. In addition, the first inner compression pocket (P2) moves toward the center of the fixed scroll 300 and changes in volume, thereby performing compression. The gas compressed by contracting the first outer compression pocket (P1) and the first inner compression pocket (P2) is discharged into the hermetic container 100 through the discharge hole 330.

Meanwhile, the operation of the opening/closing unit is described as follows. In case the opening/closing valve 140 opens the connection pipe 130, the pressure of the discharge side applies at the slider 150 and therefore the slider 150 moves toward the inside of the fixed scroll 300 to close up the connection passage 370. And, if the opening/closing unit valve 140 closes the connection pipe 130, the pressure of the first outer compression pocket (P1) is increased and therefore the slider 150 moves towards an edge of the fixed scroll 300 to open the connection passage 370, making the first outer compression pocket (P1) communicate with the suction opening 360 side.

As described so far, when the scroll compressor operates with one hundred percents of capacity, because the wrap filling portion 430 is formed, extending the entire inside of the wrap 420 of the orbiting scroll, the volumes of the compression pockets which are positioned at the suction side are greatly different from those of the compression pockets which move and are positioned to the wrap filling portion 430. In addition, while continuously passing through the wrap filling portion 430, a gas is discharged through the discharge hole 300, thereby having a very high compression ratio.

In case the scroll compressor operates with the variable capacity, when positioned at the suction side, the compression pockets communicate with the suction opening 360 and therefore compression is not performed, and when the compression pockets move, the compression is performed from the wrap filling portion 430, thereby having a very low compression ratio.

Meanwhile, in another embodiment of the present invention, the wrap filling portion 430 is formed at the fixed scroll 300, a stepped wrap portion corresponding to the wrap filling portion 430 can be provided at the wrap 420 of the orbiting scroll.

As so far described, in an apparatus for varying the capacity in a scroll compressor, a compression ratio becomes very high in case the scroll compressor operates with one percents of capacity, and a compression volume is reduced during the operation of the scroll compressor with the variable capacity. Therefore, a range of varying the capacity of the scroll compressor is entirely increased, thereby sharply reducing the power consumption. In addition, by varying the capacity by a mechanical structure, manufacturing unit cost is relatively reduced to thereby increase price competitiveness.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for varying the capacity in a scroll compressor, comprising:

an orbiting scroll provided with a wrap filling portion which is stepped at a certain height, extending the entire inside of a wrap from an outer end portion of the wrap, the height (H) of the wrap of the orbiting scroll being higher than the height (h) of the wrap filling portion;

a fixed scroll provided with a stepped wrap obtained by stepping a wrap corresponding to the wrap filling portion of the orbiting scroll and interlocked with the orbiting scroll;

a connection passage for connecting compression pockets formed by the outer wrap portion of the orbiting scroll and the inside of the wrap of the fixed scroll opposed to the outside of the outer wrap portion with the suction opening; and an opening/closing unit for opening or closing the connection passage such that the suction opening side and the compression pockets can be connected and disconnected to each other.

2. The apparatus for claim 1, wherein the opening/closing unit comprises:

a sliding space having a predetermined inner space so as to communicate with the connection passage;

a connection pipe for connecting the discharge side in which a gas is compressed by the fixed scroll and the orbiting scroll and is discharged with the sliding space;

an opening/closing valve mounted at the connection pipe and opening or closing the connection pipe; and a slider slidably inserted into the sliding space and opening or closing the connection passage while moving by the pressure difference between the discharge side and the compression pocket.

3. The apparatus of claim 2, wherein the connection pipe is connected to a through hole penetratingly formed at the fixed scroll so as to be positioned at the sliding space and a portion at which middle pressure applies.

4. The apparatus of claim 1, wherein a start portion of the wrap filling portion is formed as a curved surface.

5. The apparatus of claim 1, wherein the connection passage is formed at the fixed scroll.

6. The apparatus of claim 1, wherein the suction opening through which a gas is sucked into the compression pockets formed by the wrap of the fixed scroll and the wrap of the orbiting scroll is opened at a side portion of the fixed scroll.

7. The apparatus of claim 1, wherein one pair of compression pockets formed by the wrap of the fixed scroll and the wrap of the orbiting scroll are asymmetrical with different volumes.

8. The apparatus of claim 1, wherein one pair of compression pockets formed by the wrap of the fixed scroll and the wrap of the orbiting scroll are symmetrical having an identical volume.

* * * * *